US012472394B2

(12) United States Patent
Abbott et al.

(10) Patent No.: US 12,472,394 B2
(45) Date of Patent: Nov. 18, 2025

(54) EXERCISE EQUIPMENT CLAMP AND HANDLES

(71) Applicant: Jayflex LLC, Springville, UT (US)

(72) Inventors: Ethan Abbott, Saratoga Springs, UT (US); Ryker Haddock, Provo, UT (US)

(73) Assignee: Jayflex LLC, Springville, UT (US)

( * ) Notice: Subject to any disclaimer, the term of this patent is extended or adjusted under 35 U.S.C. 154(b) by 87 days.

(21) Appl. No.: 18/240,609

(22) Filed: Aug. 31, 2023

(65) Prior Publication Data

US 2023/0405388 A1 Dec. 21, 2023

Related U.S. Application Data

(63) Continuation of application No. 17/736,838, filed on May 4, 2022, now Pat. No. 11,752,385.

(60) Provisional application No. 63/184,681, filed on May 5, 2021.

(51) Int. Cl.
*A63B 21/072* (2006.01)

(52) U.S. Cl.
CPC ..... *A63B 21/0722* (2015.10); *A63B 21/0724* (2013.01); *A63B 21/0726* (2013.01); *A63B 21/0728* (2013.01)

(58) Field of Classification Search
CPC ..... A63B 21/0722; A63B 21/0724; A63B 21/0726; A63B 21/0728; A63B 22/02; A63B 2244/09
See application file for complete search history.

(56) References Cited

U.S. PATENT DOCUMENTS

| | | | |
|---|---|---|---|
| 1,366,200 | A | 1/1921 | Matysek |
| 3,716,650 | A | 2/1973 | de Mecquenem |
| 4,216,959 | A | 8/1980 | Niles |
| 5,496,243 | A | 3/1996 | Allen |

(Continued)

FOREIGN PATENT DOCUMENTS

| | | | |
|---|---|---|---|
| KR | 10-2010-0010113 | A | 2/2010 |
| WO | WO 2022/244277 | A1 | 11/2022 |

OTHER PUBLICATIONS

Amazon.com "keehui Heavy Duty 316SS Boat Hand Rail Fitting-Polished 90 Degree T/Tee Hinged/Split Fitting 1" Tube", date first available May 19, 2019, retrieved from the Internet on Jun. 16, 2025 (Year: 2019).*

(Continued)

*Primary Examiner* — Loan B Jimenez
*Assistant Examiner* — Kathleen M Fisk
(74) *Attorney, Agent, or Firm* — Young Basile Hanlon & MacFarlane, P.C.

(57) ABSTRACT

A clamp for exercise equipment. The clamp includes a body. The body is configured to receive a portion of a piece of exercise equipment. The body includes a first portion, a second portion and a hinge connecting the first portion and the second portion. The clamp also includes a neck. The neck is cylindrical in shape. The neck includes a first portion attached to the first portion of the body and a second portion attached to the second portion of the body. The clamp further includes a securing mechanism, the securing mechanism configured to secure the first portion of the neck to the second portion of the neck. The neck is configured to secure to an external handle when secured by the securing mechanism.

11 Claims, 12 Drawing Sheets

(56) References Cited

U.S. PATENT DOCUMENTS

| | | | | |
|---|---|---|---|---|
| 5,989,166 | A | 11/1999 | Capizzo et al. | |
| 6,893,381 | B2 | 5/2005 | Slawinski | |
| 8,267,841 | B1 | 9/2012 | Allison et al. | |
| 9,327,160 | B2 | 5/2016 | Tauriainen | |
| 9,630,045 | B1 | 4/2017 | Martin, Sr. | |
| 9,731,159 | B2 * | 8/2017 | Reynolds | A63B 21/4035 |
| 10,086,225 | B2 * | 10/2018 | Sheppard | A63B 21/0728 |
| D881,302 | S | 4/2020 | Greene | |
| 10,799,753 | B2 | 10/2020 | Koenig | |
| 11,179,588 | B2 | 11/2021 | McCall | |
| 11,324,988 | B1 | 5/2022 | Reed | |
| 11,331,530 | B2 * | 5/2022 | Amyan | A63B 21/0722 |
| 11,745,047 | B2 | 9/2023 | Vaudreuil | |
| 11,752,385 | B2 | 9/2023 | Abbott et al. | |
| 12,179,054 | B2 | 12/2024 | Breaux | |
| 2011/0173778 | A1 * | 7/2011 | Wales | B25G 3/20 16/426 |
| 2011/0177922 | A1 * | 7/2011 | Selinger | A63B 21/0724 482/107 |
| 2012/0172182 | A1 | 7/2012 | Leier et al. | |
| 2012/0252641 | A1 | 10/2012 | Odneal et al. | |
| 2013/0210589 | A1 | 8/2013 | Thompson et al. | |
| 2014/0018214 | A1 | 1/2014 | Jordan | |
| 2014/0024506 | A1 * | 1/2014 | Vixathep | A63B 21/0726 482/108 |
| 2016/0096063 | A1 | 4/2016 | Reynolds et al. | |
| 2017/0266479 | A1 | 9/2017 | McCall | |
| 2021/0402241 | A1 | 12/2021 | Carter et al. | |
| 2022/0339487 | A1 * | 10/2022 | Dickstein | A63B 21/0722 |
| 2022/0355153 | A1 | 11/2022 | Abbott et al. | |
| 2025/0001235 | A1 | 1/2025 | Abbott et al. | |

OTHER PUBLICATIONS

"Dumbbell Barbell Converter Set, Transform Dumbbells Into a Complete Home Gym—Versatile Adjustable Weight for Full Body Workouts", dated Mar. 23, 2024, Found online on May 21, 2024, https://tinyurl.com/mv5e7854, pp. 5.

"Jayflex Hyperbell Dumbbell Converter—Convert Dumbbells to Barbell Set and Kettlebell for Home Fitness—Adjustable & Up to 200 lb Capacity Weight Barbell for Weight Lifting", dated Mar. 22, 2023, Found online on May 21, 2024, https://tinyurl.com/wxmwpkdn, pp. 3.

"Jayflex Hyperbell Dumbbell Converter—Convert Dumbbells to Barbell Set and Kettlebell for Home Fitness—Adjustable & Up to 200 lb Capacity Weight Barbell for Weight Lifting", dated Aug. 28, 2023, Found online May 21, 2024 , https://www.amazon.com/Jayflex-Hyperbell-Dumbbell-Converter-Kettlebell/dp/B0CGTJW8W1, pp. 3.

Hyperbell Bar by Jayflex dated Nov. 8, 2021. Found online May 21, 2024, <https://jayflexfithess.com/products/bar-hyperbell,> pp. 4.

Ojexa Dumbbell Convert to Barbell set—Adjustable weights & Up to 200 lb Capacity Weight Barbell—Steel Clamp—Barbell—Street Clamp—Barbell Dumbbells Converter for Home Gym—Weight lifting for full body workouts, dated Nov. 30, 2023, Found online, May 21, 2024, https://tinyurl.com/mrc5n6ts, pp. 3.

* cited by examiner

EXERCISE EQUIPMENT CLAMP AND HANDLES

CROSS-REFERENCE TO RELATED APPLICATIONS

This application is a continuation of U.S. application Ser. No. 17/736,838, filed May 4, 2022, which claims the benefit of and priority to U.S. Provisional Patent Application Ser. No. 63/184,681 filed on May 5, 2021. The entire contents of these applications are incorporated herein by reference in their entirety.

BACKGROUND OF THE INVENTION

Resistance exercise equipment can get quite expensive. In particular, many users want to use dumbbells, kettlebells, barbells, etc. in order to perform many different exercises. These exercises may have the same total amount of weight but work the user's muscles very differently. As examples, barbells are used for high resistance, dumbbells are used for isolation exercises and kettlebells are used for movement exercise. These different exercises lead to very different results and a user may wish to perform all types to maximize benefits.

For example, doing a dumbbell bench press using 50 pound dumbbells (100 pounds total) is very different than a bench press using a 100 pound barbell and both of those are different than a kettle bell press using two 50 pound kettlebells. Thus, if a user wants to perform all of these exercises, that user must purchase dumbbells, kettlebells and barbell plates, all of the same weight. This can get expensive and takes far more storage room.

Accordingly, there is a need in the art for exercise equipment that allows a user to switch between dumbbells, kettlebells and barbells.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a clamp for exercise equipment. The clamp includes a body. The body is configured to receive a portion of a piece of exercise equipment. The body includes a first portion, a second portion and a hinge connecting the first portion and the second portion. The clamp also includes a neck. The neck is cylindrical in shape. The neck includes a first portion attached to the first portion of the body and a second portion attached to the second portion of the body. The clamp further includes a securing mechanism, the securing mechanism configured to secure the first portion of the neck to the second portion of the neck. The neck is configured to secure to an external handle when secured by the securing mechanism.

Another example embodiment includes a clamp for exercise equipment. The clamp includes a body. The body is configured to receive a dumbbell handle. The body includes a first portion a second portion and a hinge connecting the first portion and the second portion. The clamp also includes a grip within the body, where the grip is configured to secure the dumbbell handle. The clamp further includes a neck. The neck is cylindrical in shape. The neck includes a first portion attached to the first portion of the body a second portion attached to the second portion of the body and one or more protrusions. The clamp additionally includes a collar, the collar configured to secure the first portion of the neck to the second portion of the neck by threading onto the neck. The neck is configured to secure to an external handle when secured by the collar. One or more indentations in the external handle are configured to mate with the one or more protrusions in the neck.

Another example embodiment includes a clamp for exercise equipment. The clamp includes a body. The body is configured to receive a dumbbell handle. The body includes a first portion, a second portion and a hinge connecting the first portion and the second portion. The clamp also includes a grip within the body, where the grip is configured to secure the dumbbell handle. The clamp further includes a neck, where the neck is cylindrical in shape. The neck includes a first portion attached to the first portion of the body a second portion attached to the second portion of the body and four protrusions spaced equidistant from one another. The clamp additionally includes a collar, the collar configured to secure the first portion of the neck to the second portion of the neck by threading onto the neck. The clamp further includes a kettlebell handle. The kettlebell handle includes four indentations configured to mate with the four protrusions in the neck. The neck is configured to secure to the kettlebell handle when secured by the collar.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
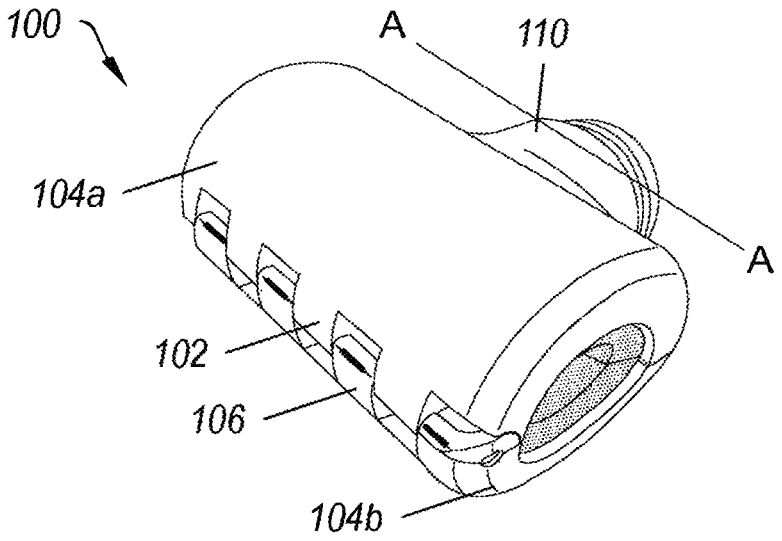
FIG. 1A illustrates a perspective view of an example of an open clamp.
Figure 1B:
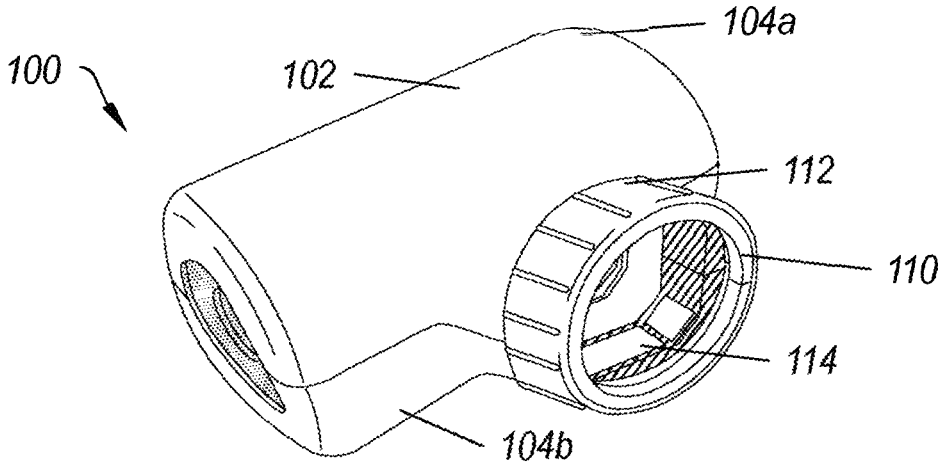
FIG. 1B illustrates an alternative perspective view of an example of an open clamp.
Figure 1C:
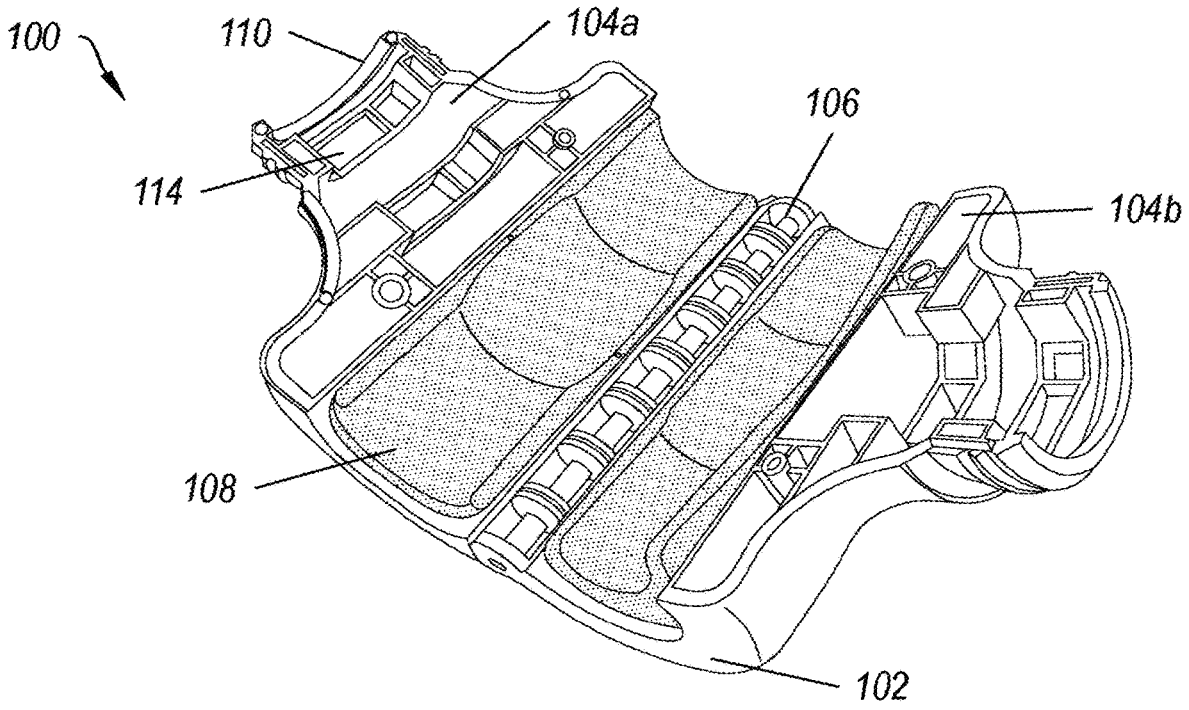
FIG. 1C illustrates an example of a closed clamp.
Figure 1D:
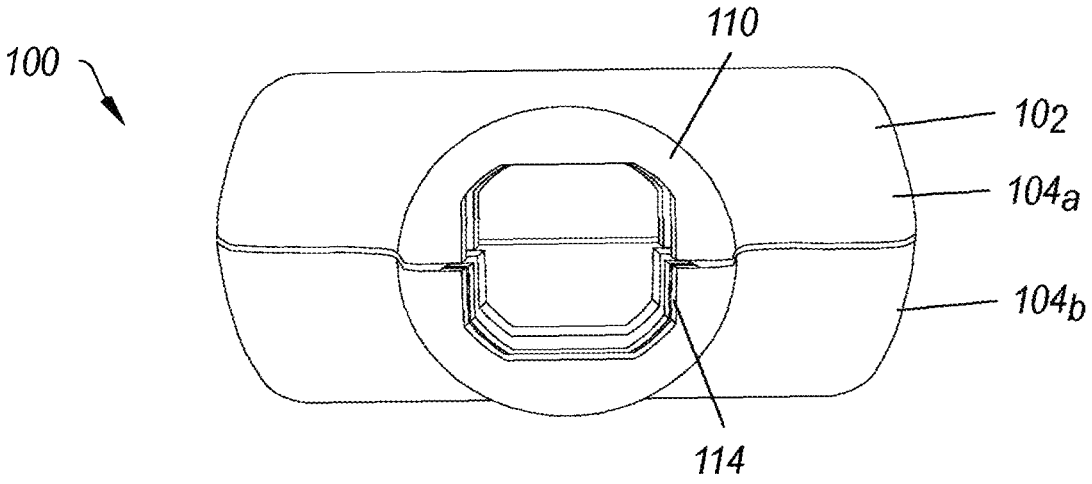
FIG. 1D illustrates a cross-section of the clamp for exercise equipment along the line A-A of FIG. 1A.
Figure 1E:
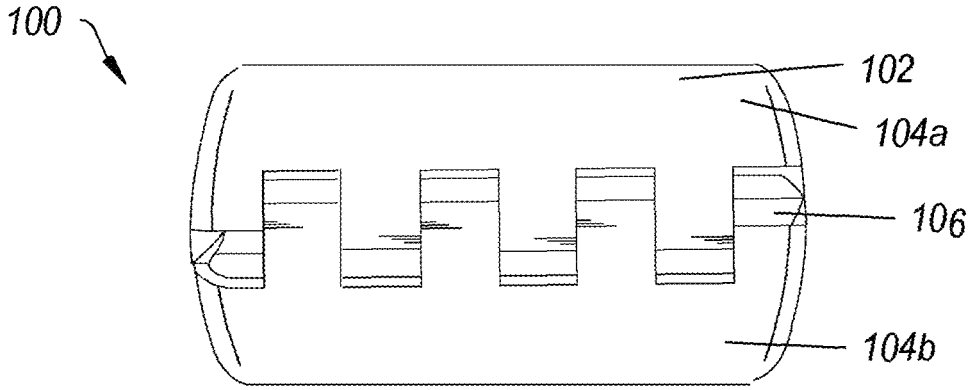
FIG. 1E illustrates a rear view of an example of a closed clamp.

FIGS. 1A, 1B, 1C, 1D, and 1E (collectively "FIG. 1") illustrate an example of a clamp 100 for exercise equipment. FIG. 1A illustrates a perspective view of an example of an open clamp 100; FIG. 1B illustrates an alternative perspective view of an example of an open clamp 100; FIG. 1C illustrates an example of a closed clamp 100; FIG. 1D illustrates a cross-section of the clamp 100 for exercise equipment along the line A-A of FIG. 1A; and FIG. 1E illustrates a rear view of an example of a closed clamp. The clamp 100 allows for attaching exercise handles (such as a kettlebell handle or barbell) to exercise equipment. I.e., the clamp 100 holds to a portion of a piece of exercise equipment (such as a dumbbell handle) and allows for attachment of a different type of exercise handle. This allows a user to use the same exercise equipment for different purposes, which means the cost of building a home gym can be greatly reduced.

FIG. 1 shows that the clamp 100 includes a body 102. The body 102 is configured to receive a portion of a piece of exercise equipment. Normally the portion of exercise equipment will be the handle, but that is not required. This is because the handle of the exercise equipment is typically smooth and even. I.e., the handle of the exercise equipment is easy to attach. However, any portion of the exercise equipment which fits into the body 102 can be attached. This may be helpful in other types of equipment, such as resistance bands. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

The body 102 can include any desired material. For example, the body 102 can be made of thermoplastics, such as polycarbonate. Polycarbonates are a group of thermoplastic polymers containing carbonate groups in their chemical structures. Polycarbonates used in engineering are strong, tough materials. They are easily worked, molded, and thermoformed.

FIG. 1 also shows that the body 102 can include a first portion 104*a* and a second portion 104*b*. The first portion 104*a* and second portion 104*b* together surround the received portion of the exercise equipment. That is, the first portion 104*a* and the second portion 104*b* together form (e.g., cooperatively form) a closed loop (e.g., a body cavity) into which the received portion of the exercise equipment is configured to be placed. This prevents the received portion of the exercise equipment from escaping from the body 102 during exercise. The first portion 104*a* and the second portion 104*b* can be identical to one another (except for the threads, which need to be different), which allows for ease of manufacture.

FIG. 1 further shows that the body 102 can include a hinge 106. The hinge 106 connects the first portion 104*a* and the second portion 104*b*. A hinge is a mechanical bearing that connects two solid objects, typically allowing only a limited angle of rotation between them. Two objects connected by a hinge rotate relative to each other about a fixed axis of rotation (e.g., a hinge axis): all other translations or rotations being prevented, and thus a hinge has one degree of freedom. Any type of hinge 106 is contemplated herein; however, the easiest type of hinge (for both manufacturing and ease of use) is a barrel hinge. A barrel hinge consists of a sectional barrel (the knuckle) secured by a pivot. A barrel is simply a hollow cylinder. Thus, the hinge 106 secures the first portion 104*a* and the second portion 104*b* and allows motion of the first portion 104*a* and the second portion 104*b* relative to one another, around a fixed axis of rotation.

FIG. 1 additionally shows that the body 102 can include a grip 108. The grip 108 is a flexible material which secures the received portion of the exercise equipment. For example, the grip 108 can include foam, or any other similar material such as rubber, vinyl, silicone, PVC, TPE, or other types of polymers. By using a flexible material for the grip 108, the received portion of the exercise equipment doesn't rotate or move laterally within the body 102. I.e., it prevents movement of the received portion of the exercise equipment within the body 102. In addition, the grip 108 allows for receiving exercise equipment of different sizes. For example, the grip 108 will accept dumbbell handles that are 3.0 inches or greater in length (most dumbbell handles are approximately 6.0 inches long). In addition, the diameter of the dumbbell handle needs to be between 0.75 and 2.0 inches at its thickest point. The grip 108 will contour to both straight and curved dumbbell handles. Some types of dumbbell which can fit within the grip 108 include hex dumbbells, Bowflex SelectTech Adjustable Dumbbells (552 and 1090), CORE Fitness, Peloton, JaxJox, MX Select, Weider, and many others.

FIG. 1 moreover shows that the body 102 can include a neck 110. As shown, the clamp 100 may have a T-shape, with the body 102 and body cavity extending along a body axis corresponding to an upper portion of the T-shape and the neck 110 and neck cavity extending along a neck axis corresponding to a stem of the T-shape. The neck axis may intersect the body axis. The body axis may be parallel to the hinge axis. The neck 110 is cylindrical in shape. The neck 110 is divided into two pieces (e.g., a first part and a second part), one on the first portion 104*a* and the second portion 104*b*. I.e., when the first portion 104*a* and the second portion 104*b* are closed around the received portion of the exercise equipment, the neck 110 is a cylinder.

FIG. 1 also shows that the clamp 100 can include a collar 112 (e.g., a fastener). The collar 112 secures to the neck 110. When the collar 112 is placed on the neck 110, the neck is held in place, meaning that the first portion 104*a* and the second portion 104*b* cannot move relative to one another, which in turn keeps the received portion of the excise equipment within the body 102. The collar 112 can attach to the neck 110 by threading onto the neck 110, snapping onto the neck 110 or through any other desired attachment method.

FIG. 1 further shows that the neck 110 includes one or more protrusions 114. The one or more protrusions 114 allow for mating of (e.g., mechanical engagement with) an external handle. The protrusions 114 serve at least two functions. They stop the clamp 100 from being removed from the external handle until desired. In addition, they stop the clamp 100 from rotating relative to the external handle. Either one (separation of the external handle or rotation of the external handle) could lead to problems, including injury, during exercise. The protrusions 114 are generally rectangular in shape, although many other shapes are contemplated herein. The protrusions 114 are generally found in the neck 110, where the external handle is inserted, but could be located in the body 102 closer to the grip 108 if so desired. The number and position of the one or more protrusions 114 can dictate the placement of the handle relative to the clamp 100. For example, four protrusions 114 spaced regularly can allow the external handle to be rotated 90 degrees, 180 degrees, and 270 degrees relative to the clamp 100. This can allow different configurations, as described below.

Figure 2:
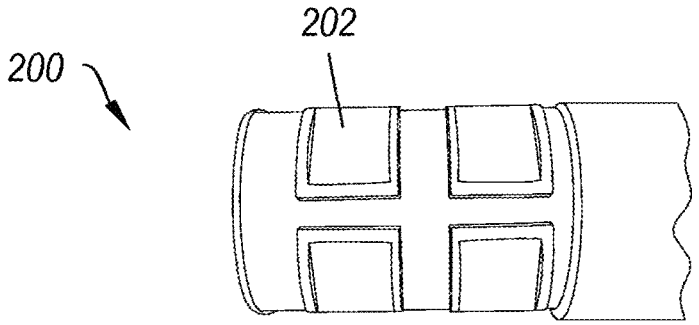
FIG. 2 illustrates an example of an external handle to be inserted into a clamp, such as the clamp of FIG. 1.

FIG. 2 illustrates an example of an external handle 200 to be inserted into a clamp, such as the clamp 100 of FIG. 1. The external handle can be any desired handle, such as a barbell, curl bar, kettle bell handle, macebell handle, trap bar, etc. I.e., the handle can be vary greatly, allowing the user to select from a wide range of equipment, all using a single set of weights, such as dumbbells.

FIG. 2 shows that the external handle 200 can include one or more indentations 202. The one or more indentations 202 are configured to mate with the protrusions in a clamp (such as the protrusions 110 of FIG. 1). The one or more indentations 202 serve at least two functions. They stop the clamp from being removed from the external handle 200 until desired. In addition, they stop the clamp from rotating relative to the external handle 200. Either one (separation of the external handle 200 or rotation of the external handle 200) could lead to problems, including injury, during exercise. The one or more indentations 202 are generally rectangular in shape, although many other shapes are contemplated herein. As long as the indentation match the protrusions in the clamp and serve the above functions, then they are an acceptable size and shape. The one or more indentations 202 are generally found near the end of the external handle 200, where the external handle 200 is inserted into the clamp but could be located farther from the edge of the external handle 200 if more of the handle is to be inserted into the clamp. The number and position of the one or more indentations 202 can dictate the placement of the handle relative to the clamp 100. For example, four indentation 202 spaced regularly can allow the external handle 200 to be rotated 90 degrees, 180 degrees, and 270 degrees relative to the clamp. This can allow different configurations, as described below.

Figure 3A:
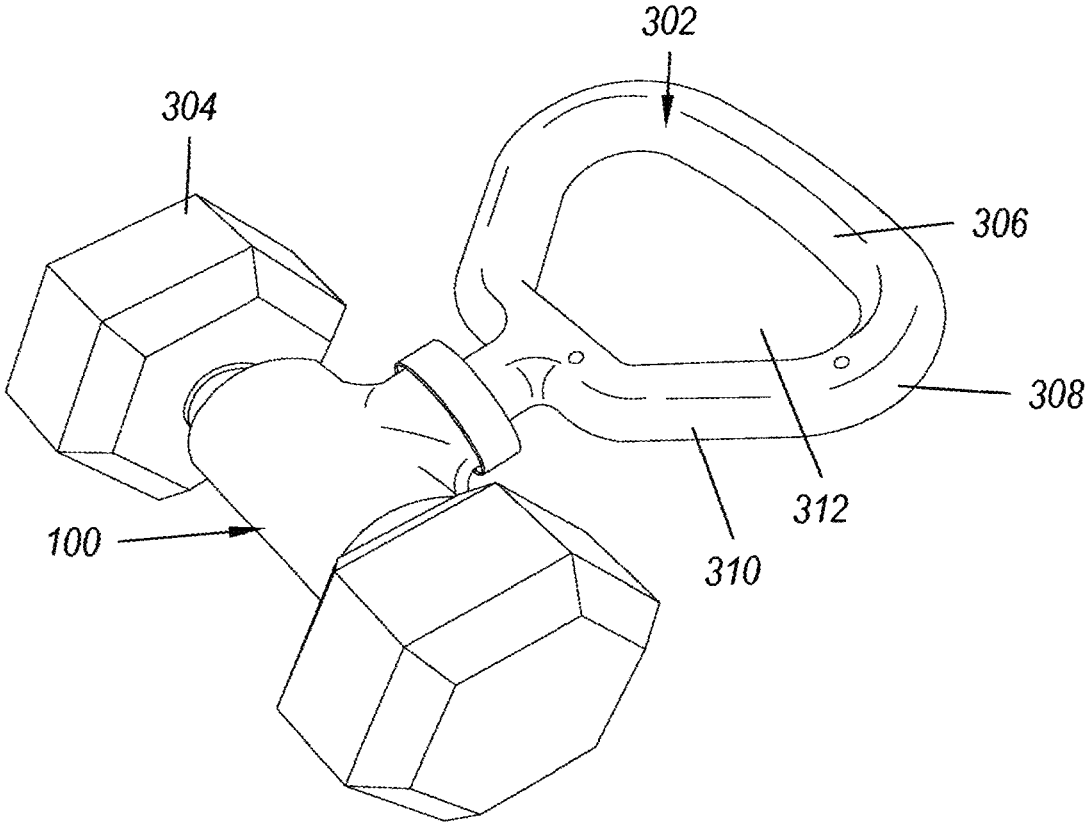
FIG. 3A shows the example of kettlebell handle in combination with a closed clamp in combination with a dumbbell.
Figure 3B:
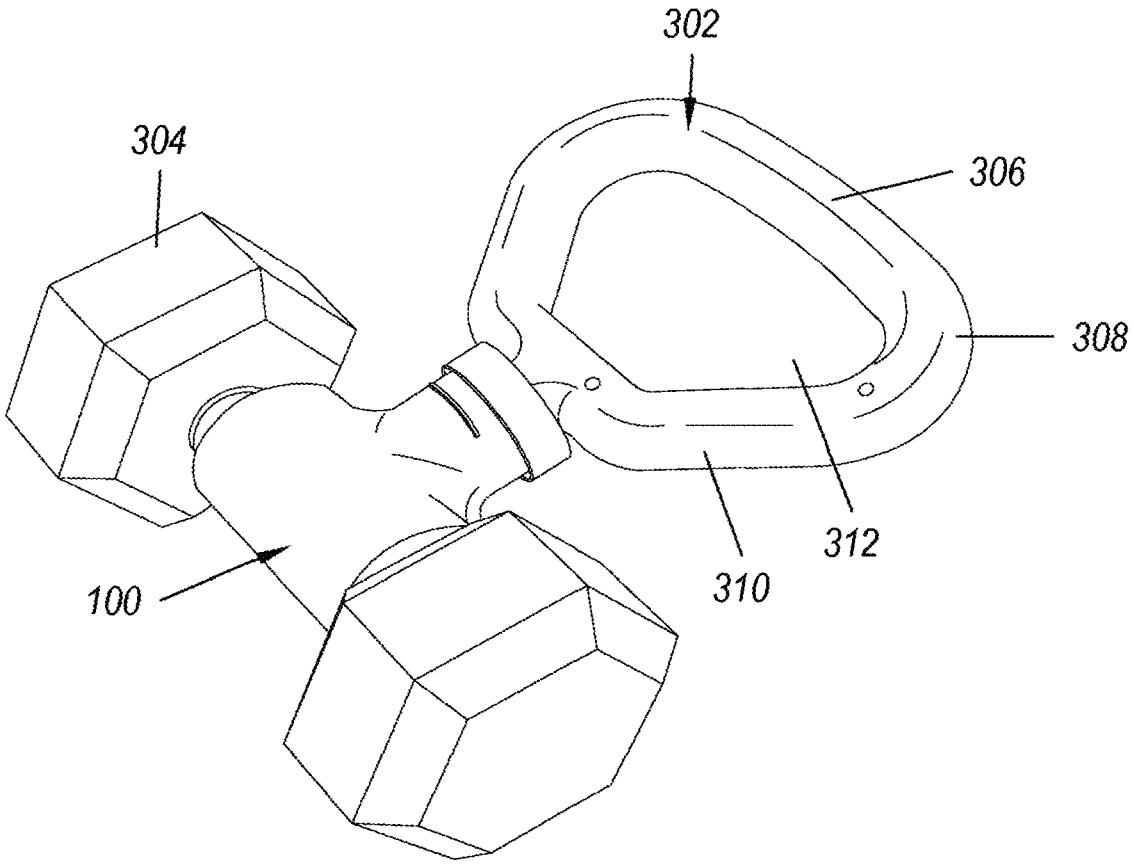
FIG. 3B shows the example of kettlebell handle in combination with a clamp 100 with the collar unlocked in combination with a dumbbell.
Figure 3C:
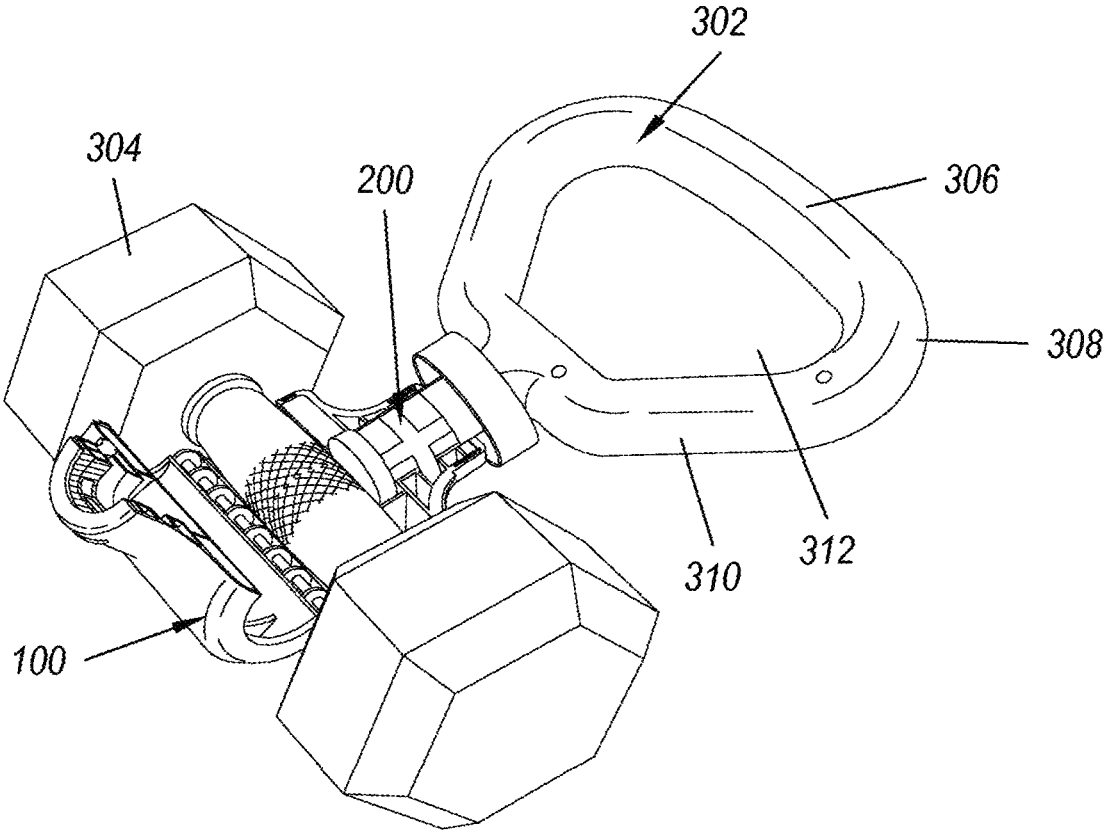
FIG. 3C shows the example of kettlebell handle in combination with a clamp in an open position in combination with a dumbbell.

FIGS. 3A-3C (collectively "FIG. 3") illustrate an example of a kettlebell handle 302 in combination with a clamp 100. FIG. 3A shows the example of kettlebell handle 302 in combination with a closed clamp 100 and in combination with a dumbbell 304; FIG. 3B shows the example of kettlebell handle 302 in combination with a clamp 100 with the collar 112 unlocked and in combination with a dumbbell 304; and FIG. 3C shows the example of kettlebell handle 302 in combination with a clamp 100 in an open position and in combination with a dumbbell 304. The kettlebell handle 302 and clamp 100 together are configured to allow a user to transform a dumbbell 304 into a kettlebell. That is, a user can attach the kettlebell handle 302 and clamp 100 to a dumbbell 304 and then use the handle 302/clamp 100/dumbbell 304 combination as if it were a kettlebell.

Unlike traditional dumbbells, a kettlebell's center of mass is extended beyond the hand. This facilitates ballistic and swinging movements. The kettlebell allows for swing movements and release moves with added safety and added grip, wrist, arm and core strengthening. The weight of a kettlebell is not distributed evenly. Thus, the unique shape of a kettlebell provides the "unstable force" for handling—key for the effectiveness of the kettlebell exercises. By their nature, typical kettlebell exercises build strength and endurance, particularly in the lower back, legs, and shoulders, and increase grip strength. Unlike the exercises with dumbbells or barbells, kettlebell exercises involve large numbers of repetitions in the sport and can also involve large reps in normal training. Kettlebell exercises are in their nature holistic; therefore, they work several muscles simultaneously and may be repeated continuously for several minutes or with short breaks. This combination makes the exercise partially aerobic and more similar to high-intensity interval training rather than to traditional weight lifting.

Some exercises are uniquely suited to the kettlebell for one reason or another (although other exercises can be performed with kettlebells). For example, exercises which can be done with a single kettlebell include (but are not limited to): American swing, Turkish get-up, halo, arm bar, slingshot, slingshot lunge, circular swing, figure-8 swing, circular clean, deck squat, helping hand press, isometric holds, bent press, arm bar floor press, and Russian twist. Exercises which can be done with two kettlebells include (but are not limited to): renegade row, alternating clean, pushup, and carry. Exercises which can be done with a single kettlebell or with two or more kettlebells include (but are not limited to): conventional swing, high pull, hang clean, swing clean, dead clean, snatch, strict press, floor press, push press, jerk, thruster, squat, overhead squat, sots press, lunge press, pistol squat, deadlift, carry, row, lunge, lateral lunge, lateral lunge clean, squat get-up, windmill, and farmer's walk.

FIG. 3 shows that the kettlebell handle 302 is a "loop" of material. The size and shape of the loop can vary based on a number of factors, such as user hand size, exercises desired to be performed, material used, etc. The kettlebell handle 302 is cylindrical with a diameter of approximately 1.25 inches. The kettlebell handle 302 is comprised of any desired material, such as polycarbonate. The surface of the kettlebell handle 302 can be textured to prevent slipping when being held by a user. As used in the specification and the claims, the term approximately shall mean that the value is within 10% of the stated value, unless otherwise specified.

FIG. 3 shows that the kettlebell handle 302 can include a handgrip 306. The handgrip 306 includes a portion of the kettlebell handle 302 where the user can wrap his/her hands around the kettlebell handle 302. Exemplarily, the handgrip 306 is approximately 6 inches in length, allowing the user to place one or both hands on the handgrip 306.

FIG. 3 shows that the kettlebell handle 302 includes an external handle 200 which can mate with the clamp 100. If the external handle 200 includes rotational symmetry, then the kettlebell handle can be rotated relative to the clamp 100 (and therefore the dumbbell 304), which allows for variation of exercises. For example, because the kettlebell handle 302 as shown has two-fold symmetry but the external handle 200 as shown has four-fold symmetry, then the handgrip 306 can be aligned in axis with the dumbbell 304 or perpendicular to the dumbbell 304.

FIG. 3 also shows that the kettlebell handle 302 can include corners 308. The corners 308 are at each end of the handgrip 306. The corners 308 are where the kettlebell handle 302 turns from the handgrip toward the center of gravity (which in this configuration would be somewhere near the middle of the dumbbell handle—the exact location would depend on the weight of the dumbbell used). The corners 308 form an area where the user can use an alternative grip to the handgrip 306. I.e., if the user holds the kettlebell 302 at the corners 308 in an overhand grip (palm on the outside of the corners 308 and fingers wrapped around into the interior of the corners 308) or an underhand grip (palm on the inside of the corners 308 and fingers wrapped around to the exteriors of the corners 308) to change the dynamics of an exercise. For example, if the user is holding the kettlebell handle 302 straight out, then the exercise is different if the user is holding the handgrip 306 versus the corners 308.

FIG. 3 further shows that the kettlebell handle 302 can include horns 310. The horns 310 connect the corners 308 to the external handle 200 of the kettlebell handle 302. This completes the loop of the kettlebell handle 302. Just as with the corners 308, the horns 310 allow the user to utilize different grips in order to vary exercises.

FIG. 3 shows that the kettlebell handle 302 can include a window 312. The window 312 is an opening through which the user's hands, arms, feet, or other objects can be inserted. I.e., the kettlebell handle 302 is a loop, and the window 312 is the interior portion of the loop.

In addition, kettlebells have portions usually referred to as the "bell" and the "base". These are both formed by the dumbbell 304 when the clamp 100 is closed around the dumbbell handle 314. Likewise, the offset weight of the kettlebell is created by the attached dumbbell 304. Thus, with a single kettlebell handle 302 or pair of kettlebell handles 302, the user can covert a dumbbell set into a matching kettlebell set. This greatly reduces the cost and storage space needed to create a home gym.

Figure 4A:
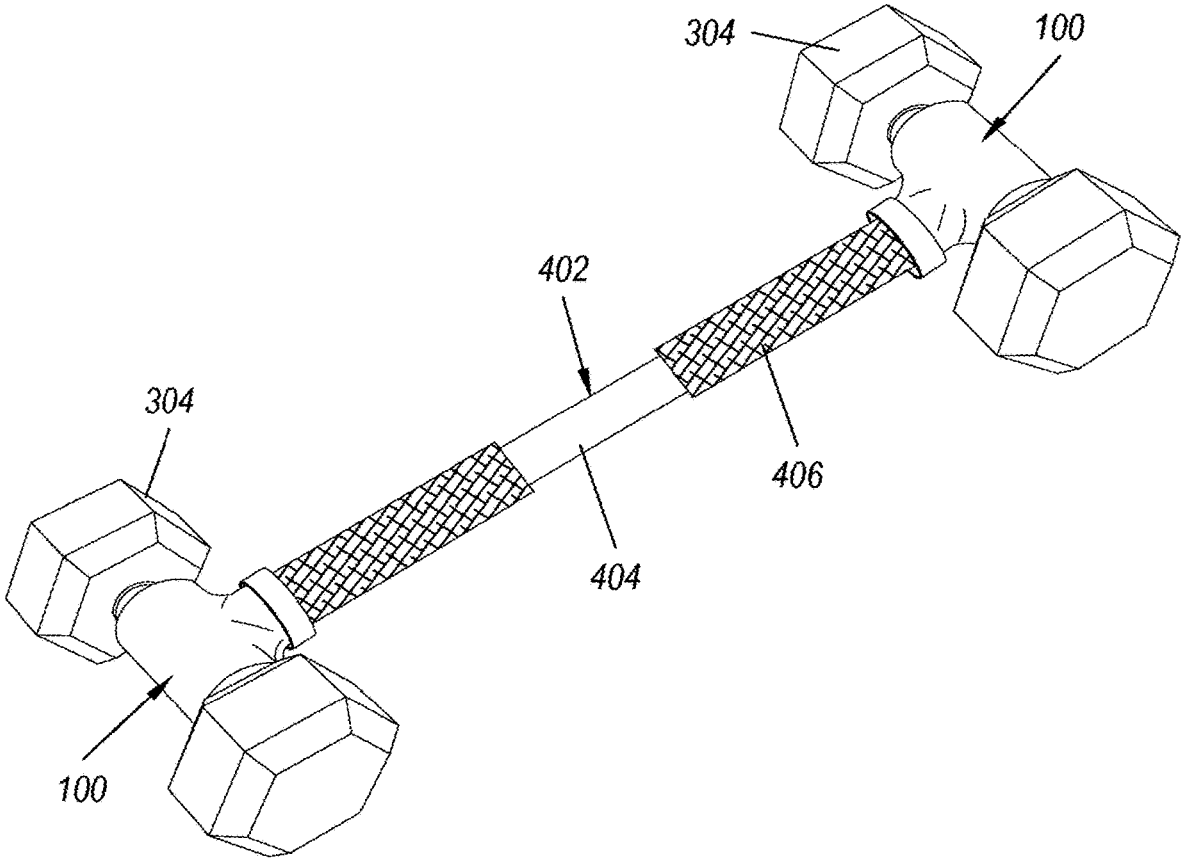
FIG. 4A shows the example of the barbell handle including a pair of closed clamps in combination with a pair of dumbbells.
Figure 4B:
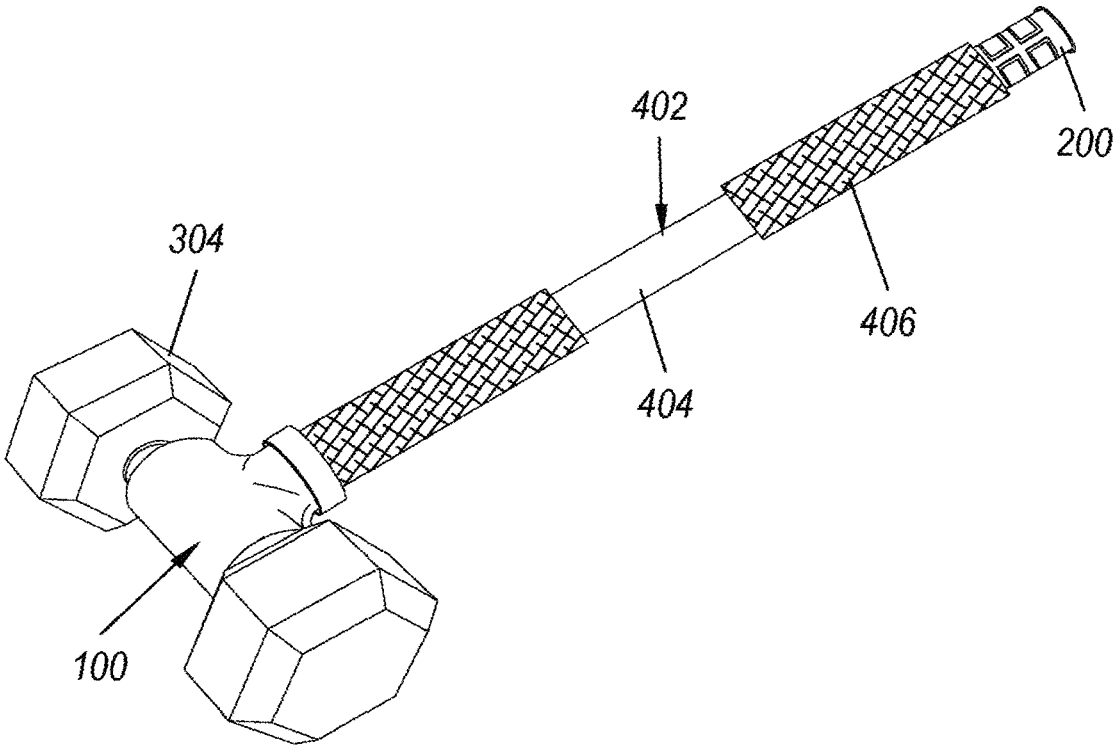
FIG. 4B shows the example of the barbell handle including a single closed clamp in combination with a single dumbbell.
Figure 4C:
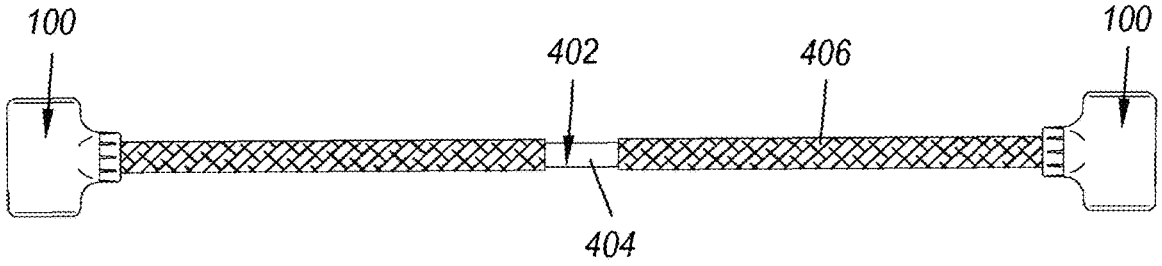
FIG. 4C shows a top view of the example of the barbell handle including a pair of closed clamps, with the bottom view being a mirror image thereof.
Figure 4D:
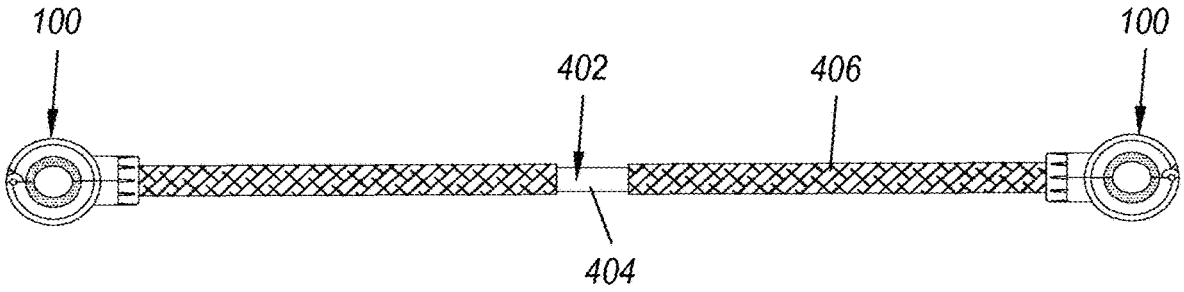
FIG. 4D shows a front view of the example of the barbell handle including a pair of closed clamps, with the rear view being a mirror image thereof.
Figure 4E:
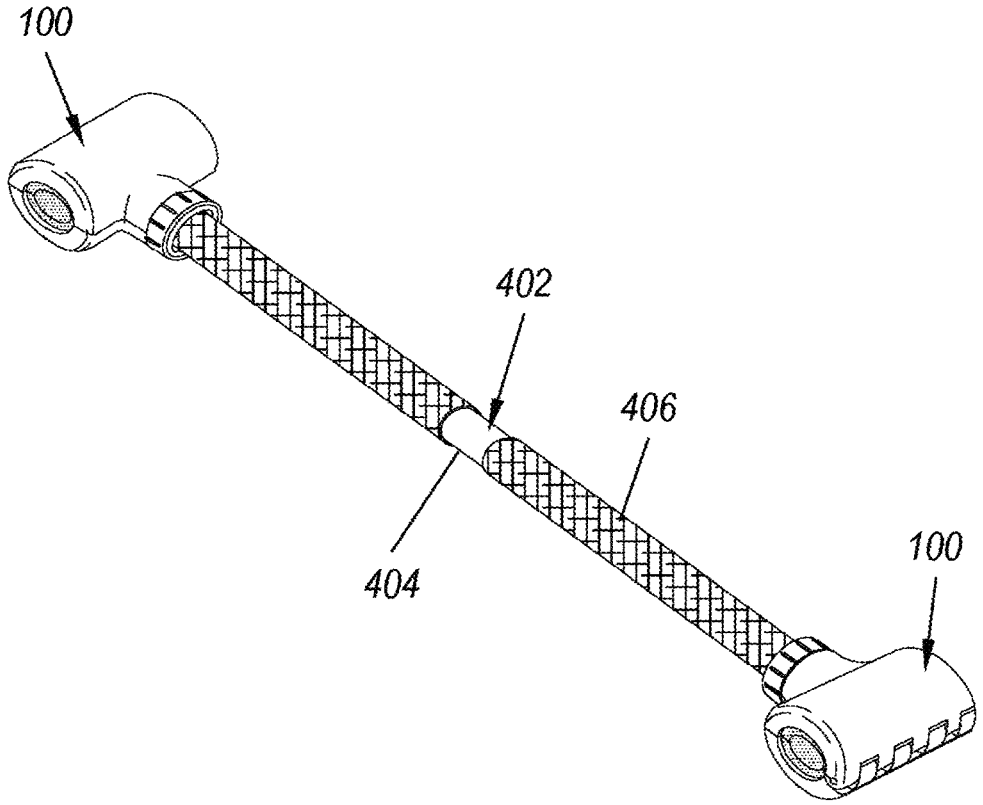
FIG. 4E shows a perspective view of the example of the barbell handle including a pair of closed clamps.

FIGS. 4A-4B (collectively "FIG. 4") illustrate an example of a barbell handle 402. FIG. 4A shows the example of the barbell handle 402 including a pair of closed clamps 100 in combination with a pair of dumbbells 304; FIG. 4B shows the example of the barbell handle 402 including a single closed clamp 100 in combination with a single dumbbell 304; FIG. 4C shows a top view of the example of the barbell handle 402 including a pair of closed clamps 100, with the bottom view being a mirror image thereof; FIG. 4D shows a front view of the example of the barbell handle 402 including a pair of closed clamps 100, with the rear view being a mirror image thereof; and FIG. 4E shows a perspective view of the example of the barbell handle 402 including a pair of closed clamps 100. The barbell handle 402 and clamp 100 together are configured to allow a user to transform a dumbbell 304 into a barbell. That is, a user can attach the barbell handle 402 and clamp 100 to a dumbbell 304 and then use the handle 402/clamp 100/dumbbell 304 combination as if it were a barbell.

A barbell is a piece of exercise equipment used in weight training, bodybuilding, weightlifting and powerlifting, consisting of a long bar, usually with weights attached at each end. Barbells range in length from 1.2 meters (4 ft) to above 2.4 meters (8 ft), although bars longer than 2.2 meters (7.2 ft) are used primarily by powerlifters and are not commonplace. The central portion of the bar varies in diameter from 25 millimeters (0.98 in) to 50 millimeters (1.96 in) and is often engraved with a knurled crosshatch pattern to help lifters maintain a solid grip. Weight plates slide onto the outer portions of the bar to increase or decrease the desired total weight.

One can view a barbell as a longer version of the dumbbell that is used for free weight training and competitive sports, such as powerlifting, Olympic weightlifting, and CrossFit. Many exercises can be done using the barbell, such as bicep curl, bench press, Olympic weightlifting, overhead press, deadlift, and squat. Olympic barbells are usually an estimated weight of 20 kilograms (44 lb.), but the weight of a barbell can vary depending on the desired use. Many fitness categories use the barbell for different reasons, for example, powerlifters use the barbell to perform compound exercise movements.

FIG. 4 shows that the barbell handle 402 includes a bar 404. The size and shape of the bar 404 can vary based on a number of factors, such as exercises desired to be performed, material used, etc. Exemplary, the size of the bar 404 can be is cylindrical with a diameter of approximately 1 inch and have a length of approximately 36 inches. The bar 404 is comprised of any desired material, such as steel. The surface of the bar 404 can be textured to prevent slipping when being held by a user. A powder coating, knurling, grip, or tape can be used to prevent slipping.

FIG. 4 shows that the barbell handle 402 can include a handgrip 406. The handgrip 406 is the portion of the bar 404 where the user wraps his/her hands around the barbell handle 402. Then handgrip 406 includes vinyl, rubber or a similar material such as PVC, TPE, silicone, or other common polymers used for grips. The handgrip 406 prevents the user's hands from slipping.

FIG. 4 shows that the barbell handle 402 includes an external handle 200 which can mate with the clamp 100. Rotational symmetry is not as important to the barbell handle 402 as the kettlebell handle 302, discussed above.

Removing a clamp 100 from a single external handle 200 allows the user to use the barbell handle 402 as a macebell. This allows the user to do sledgehammer type exercises. I.e., only a single dumbbell will be attached to the bar clamp. This allows the user to perform exercises such as hammering tires or other hammer workouts.

Figure 5:
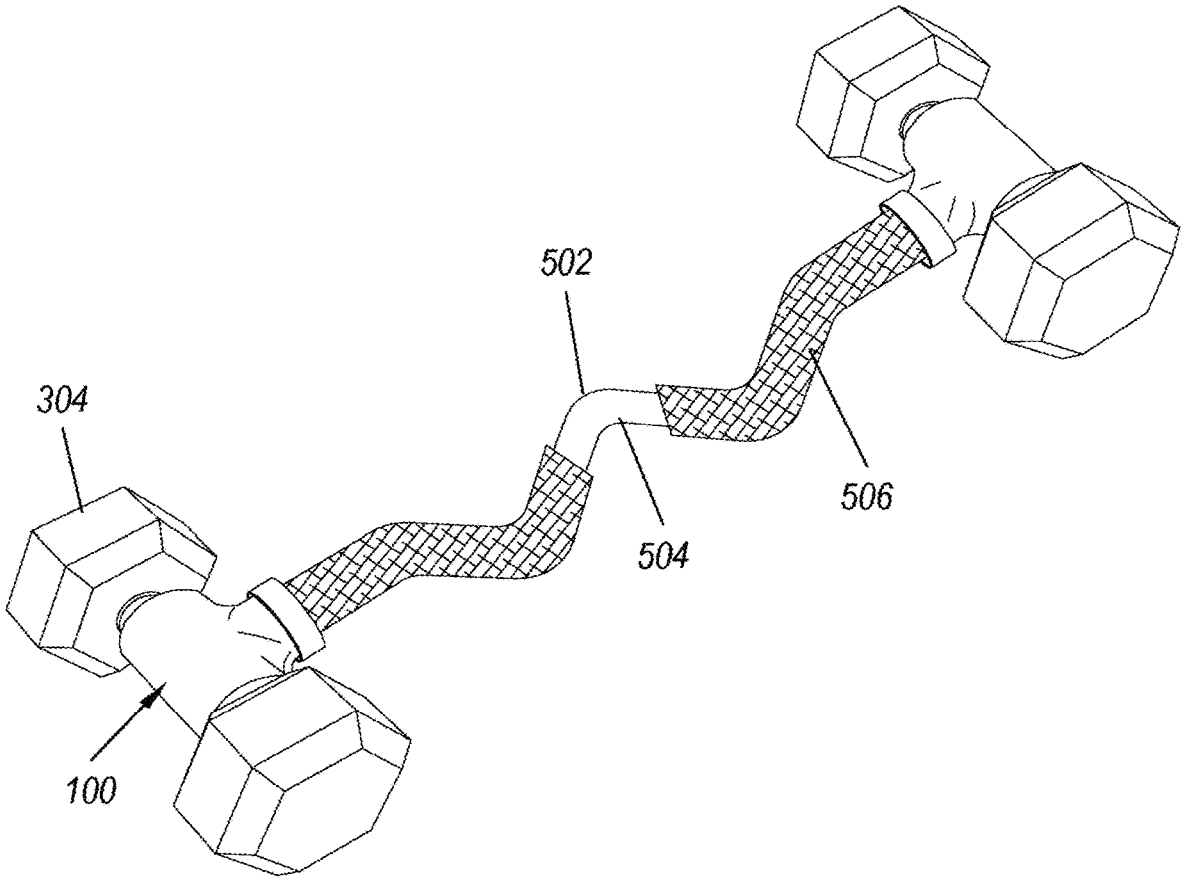
FIG. 5 illustrates an example of an EZ curl bar handle including a pair of closed clamps in combination with a pair of dumbbells.

FIG. 5 illustrates an example of an EZ curl bar handle 502 including a pair of closed clamps 100 in combination with a pair of dumbbells 304. The EZ curl bar handle 502 and clamp 100 together are configured to allow a user to transform a dumbbell 304 into a EZ curl bar. That is, a user can attach the EZ curl bar handle 502 and clamp 100 to a dumbbell 304 and then use the handle 502/clamp 100/dumbbell 304 combination as if it were a EZ curl bar.

A EZ curl bar is a piece of exercise equipment used in weight training, bodybuilding, weightlifting and powerlifting, consisting of a non-straight bar, usually with weights attached at each end. The central portion of the bar varies in diameter from 25 millimeters (0.98 in) to 50 millimeters (1.96 in) and is often engraved with a knurled crosshatch pattern to help lifters maintain a solid grip. Weight plates slide onto the outer portions of the bar to increase or decrease the desired total weight. EZ curl bars are configured to turn the user's hands slightly for use during bicep curls. The angles of the bar allow for increased comfort of the wrists when doing certain exercises and to better isolate certain muscles, such as the biceps.

FIG. 5 shows that the EZ curl bar handle 502 includes a bar 504. The size and shape of the bar 504 can vary based on a number of factors, such as exercises desired to be performed, material used, etc. Exemplary, the size of the bar 504 can be is cylindrical with a diameter of approximately 1 inch and have a length of approximately 36 inches. The bar is comprised of any desired material, such as steel. The surface of the bar 504 can be textured to prevent slipping when being held by a user.

FIG. 5 also shows that the bar 504 is not straight as in a barbell. This allows a user to turn his/her hands slightly while performing a barbell curl. This makes the exercise more comfortable for the user.

FIG. 5 shows that the EZ curl bar handle 502 can include a handgrip 506. The handgrip 506 is the portion of the bar 504 where the user wraps his/her hands around the EZ curl bar handle 502. Then handgrip 506 includes vinyl, but other materials can be used such as rubber, TPE, PVC, silicone, or other polymers and prevents the user's hands from slipping. A texture such as a knurling can also be applied directly to the steel bar to prevent hands from slipping.

FIG. 5 shows that the EZ curl bar handle 502 includes an external handle (not shown) which can mate with the clamp 100. Rotational symmetry is not as important to the EZ curl bar handle 502 as the kettlebell handle 302, discussed above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A clamp for exercise equipment, the clamp comprising:

a first portion having a first body cavity and a first neck cavity;

a second portion having a second body cavity and a second neck cavity; and a hinge rotatably connecting the first portion and the second portion to provide an open configuration of the clamp and a closed configuration of the clamp, wherein the clamp in the open configuration includes:

at least one of the first body cavity or the second body cavity being configured to receive a portion of exercise equipment, and at least one of the first neck cavity or the second neck cavity being configured to receive a portion of an external handle; and wherein the clamp in the closed configuration has a T-shape and includes:

the first body cavity and the second body cavity cooperatively forming a body cavity shaped to extend around the portion of the exercise equipment, the body cavity extending along a body axis aligned with an upper portion of the T-shape, and the first neck cavity and the second neck cavity cooperatively forming a neck cavity shaped to extend around the portion of the external handle, the neck cavity extending along a neck axis aligned with a stem of the T-shape, and wherein at least one of the first neck cavity or the second neck cavity comprises a protrusion configured to mechanically engage a corresponding indentation of the external handle to align the portion of the external handle relative to the at least one of the first neck cavity or the second neck cavity.

2. The clamp of claim 1, wherein the clamp in the closed configuration further includes:

the neck axis extending perpendicular to the body axis and intersecting the body axis at a middle of the body cavity.

3. The clamp of claim 2, wherein the hinge connects the first portion and the second portion to pivot about a hinge axis that is parallel to the body axis.

4. The clamp of claim 1, wherein the protrusion is configured to mechanically engage the corresponding indentation of the portion of the external handle to prevent the clamp from translating relative to the external handle.

5. The clamp of claim 4, wherein the protrusion is configured to mechanically engage the corresponding indentation of the portion of the external handle to prevent the clamp from rotating relative to the external handle.

6. The clamp of claim 1, further comprising a grip positioned in at least one of the first body cavity or the second body cavity that is configured to secure the portion of the exercise equipment to the clamp when the clamp is in the closed configuration.

7. A method for clamping exercise equipment, the method comprising:

receiving a portion of exercise equipment in a body cavity part of at least one of a first portion of a clamp or a second portion of the clamp;

rotating the first portion and the second portion relative to each other to a closed configuration in which the clamp forms a T-shape and the first portion and the second portion together form:

a body cavity in which the portion of exercise equipment is secured, the body cavity being aligned with an upper portion of the T-shape, and a neck cavity in which a part of an external handle comprising an indentation is secured by a mechanical engagement between a protrusion and the indentation of the part of the external handle, the protrusion extending into the neck cavity, the neck cavity being aligned with a stem portion of the T-shape; and releasably securing the first portion and the second portion in the closed configuration.

8. The method of claim 7, wherein:

the first portion has a first body cavity part and a first neck cavity part;

the second portion has a second body cavity part and a second neck cavity part; and the closed configuration comprises the first body cavity part and the second body cavity part combining to form the body cavity and the first neck cavity part and the second neck cavity part combining to form the neck cavity.

9. The method of claim 7, wherein:

the body cavity extends along a first axis; and the neck cavity extends along a second axis that intersects the first axis.

10. The method of claim 7, wherein rotating the first portion and the second portion relative to each other to the closed configuration includes securing the part of the external handle and the portion of exercise equipment between the first portion and the second portion.

11. A clamp for exercise equipment, the clamp comprising:

a first portion having a first body cavity and a first neck cavity;

a second portion having a second body cavity and a second neck cavity, wherein the first portion and the second portion are rotatably connected to provide an open configuration of the clamp and a closed configuration of the clamp; and a fastener configured to extend around at least one of the first portion or the second portion to secure the clamp in the closed configuration, wherein the clamp in the open configuration includes:

at least one of the first body cavity or the second body cavity being configured to receive a portion of the exercise equipment, and at least one of the first neck cavity or the second neck cavity being configured to receive a portion of an external handle; and wherein the clamp in the closed configuration includes:

the first body cavity and the second body cavity being configured to cooperatively extend around the portion of the exercise equipment, the first neck cavity and the second neck cavity being configured to cooperatively extend around the portion of the external handle, and the clamp forming a T-shape in which the first body cavity and the second body cavity combine to form a body cavity corresponding to an upper portion of the T-shape and the first neck cavity and the second neck cavity combine to form a neck cavity corresponding to a stem of the T-shape.

* * * * *